US005467548A

United States Patent [19]

Ross

[11] Patent Number: 5,467,548

[45] Date of Patent: Nov. 21, 1995

[54] PROTECTIVE BARRIER MEMBERS FOR WORK AREAS

[76] Inventor: Charles N. Ross, 48 Meander Close, Carlisle, Ontario, Canada, L0R 1H1

[21] Appl. No.: 281,091

[22] Filed: Jul. 27, 1994

[51] Int. Cl.[6] ..... E01F 9/012; E01F 13/02

[52] U.S. Cl. ..... 40/612; 116/63 C; 404/9

[58] Field of Search ..... 40/612, 200, 607, 40/612, 614; 116/63 P, 63 C; 404/6, 9, 10; 256/1, 13.1, DIG. 6

[56] References Cited

U.S. PATENT DOCUMENTS

| | | | |
|---|---|---|---|
| 1,898,379 | 2/1933 | Meehan | 40/200 |
| 4,050,401 | 9/1977 | Kelly | 116/63 P |
| 4,262,438 | 4/1981 | Scherer | 40/607 |
| 5,030,029 | 7/1991 | Johnsen | 404/6 |
| 5,195,453 | 3/1993 | McGibbon, II | 116/63 P X |

FOREIGN PATENT DOCUMENTS

| | | | |
|---|---|---|---|
| 560539 | 9/1993 | European Pat. Off. | 256/13.1 |
| 5140916 | 6/1993 | Japan | 404/9 |
| 2182701 | 5/1987 | United Kingdom | 116/63 C |
| 2207942 | 2/1989 | United Kingdom | 404/9 |
| 2225800 | 6/1990 | United Kingdom | 49/49 |

*Primary Examiner*—Ramon S. Britts
*Assistant Examiner*—James A. Lisehora
*Attorney, Agent, or Firm*—McConnell and Fox

[57] ABSTRACT

A barrier member adapted for easy mounting on and dismounting from a pair of conical pylon road members comprises an elongated barrier body, usually of thin sheet metal, providing a vertical barrier surface with a pylon-engaging member at each end. Each pylon-engaging member has an aperture of such diameter that it can be mounted on the pylon upper end with the end protruding through the aperture so that the barrier member is retained against transverse movement and is maintained at a predetermined distance above the road surface. Preferably the pylon-engaging member is formed from round cross section rod to provide wedging tangential retaining contact between itself and the softer plastics material of the pylon outer wall upon pressing the member downward on the pylon. The barrier body has a wider portion extending vertically and a narrower portion extending at an angle to the wider portion to increase the transverse rigidity, the pylon-engaging members being attached at their junction. The wider portion may have a central shallow recess therein which increase its rigidity and in which legends and printing are located to protect them against scraping damage.

17 Claims, 1 Drawing Sheet

FIG. 1
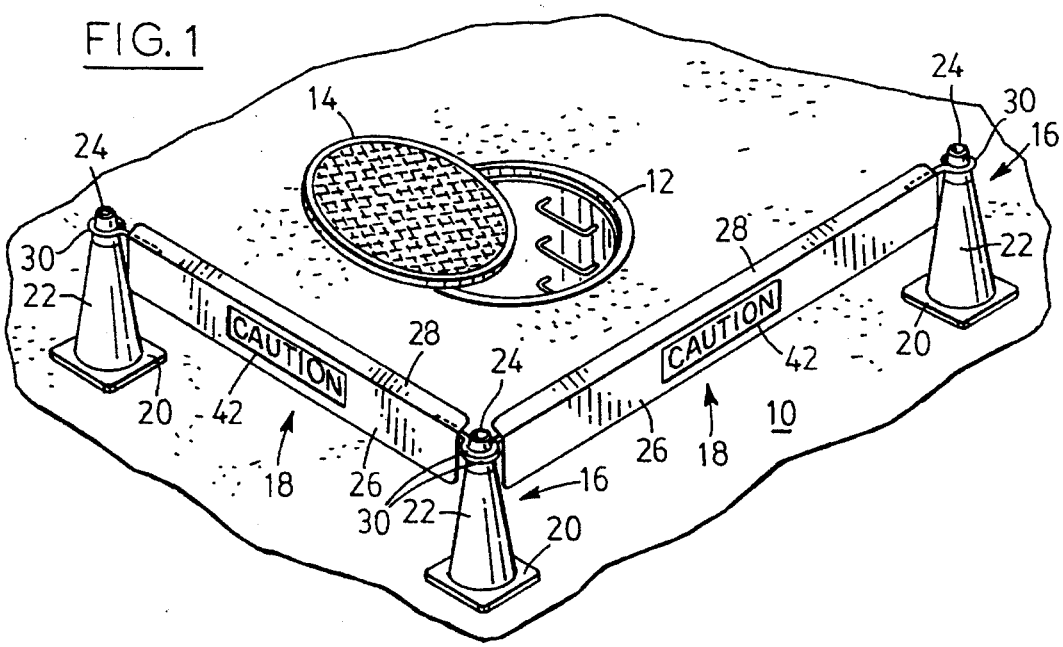
FIG. 2
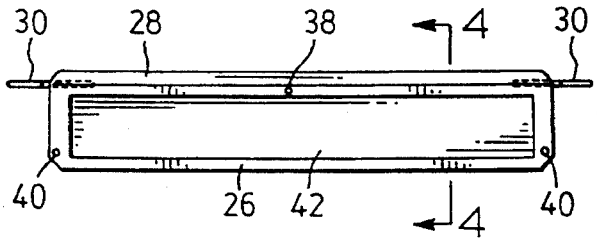
FIG. 4
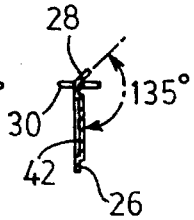
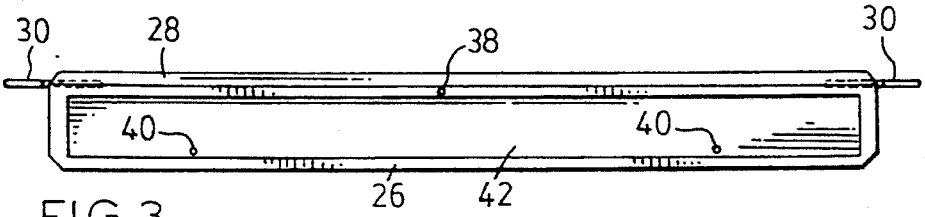
FIG. 3
FIG. 5
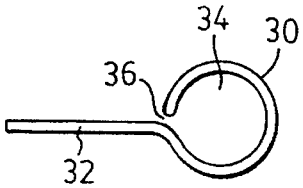
FIG. 6
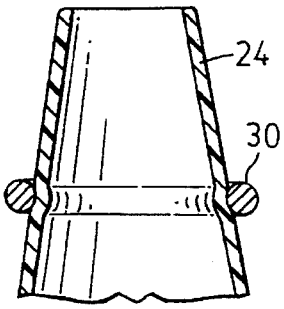
FIG. 7
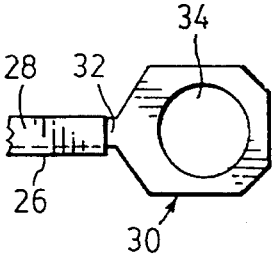

PROTECTIVE BARRIER MEMBERS FOR WORK AREAS

FIELD OF THE INVENTION

This invention is concerned with new protective barrier members for work areas, and especially with such members adapted for use in combination with existing pylon type road and highway safety markers to provide a more complete and visible barrier.

REVIEW OF THE PRIOR ART

Businesses and authorities concerned with construction and repair, particularly street, road and highway, construction, repair and control make extensive use of pylons of moulded plastics materials to mark off temporarily a work area needing protection, such as a section of sidewalk, street, road or highway (hereinafter for convenience referred to simply as a road) to which access is to be restricted or denied. Typically such pylon markers are tapered upward inward to be of conical shape, are hollow, and include an integral wider base portion, usually square in plan, that contacts the road surface. Their popularity results from a number of advantages that they have over the wood and metal post members used before their introduction. For example, the hollow conical shape facilitates their production in quantity relatively inexpensively by rotary moulding, and also makes it easy to store large numbers expeditiously in a relatively small space by stacking them vertically. They are comparatively light in weight so that they are easy to handle, and the plastics materials that are used can be self coloured throughout with the required distinctive colour, usually a bright red orange, so that the colour is permanent despite wear and weathering, reducing maintenance as compared to wood and metal posts which must be repainted at intervals. Further, their flat base makes them very stable as they sit on the road surface, while their sloping sidewalls plus their lightweight construction makes them less susceptible to damage if they are struck by a vehicle, and also helps to ensure that they cause minimum or no damage to the striking vehicle.

There are however a number of situations where these pylon markers have been at a disadvantage as compared to some prior art barrier members, where for example it is desired to present a complete barrier in order to close a street or road section, or enclose a work area such as a pothole or an open manhole, so that the barrier cannot be bypassed easily by a pedestrian or vehicle passing between the spaced pylons, or by moving one or two of the pylons aside. Again, the fact that they are light and easily moved can become a disadvantage, in that they are correspondingly easily moved out of line, so that the position of the barrier becomes indeterminate. If the movement out of line puts them in the traffic lane they may become somewhat of a traffic hazard, since motorists instinctively will swerve to try to avoid such a bulky object in the road. One way in which a more complete barrier has been provided is to string a distinctive flexible barrier tape between the pylons, but this is difficult to fasten securely to the pylons and is only suitable as a temporary expedient.

DEFINITION OF THE INVENTION

It is an object of the invention therefore to provide new barrier members adapted for securely connecting together pairs of pylons to provide a more complete protective barrier.

It is another object to provide such new barrier members adapted to provide a more visible barrier.

It is a more specific object to provide such new barrier members adapted for use in securely connecting together pairs of conical pylons of plastics materials in order to provide a more complete and visible barrier.

In accordance with the invention there is provided a barrier member adapted for mounting on a pair of spaced road mounted vertically extending conical pylon members each having an upper and a lower end, the barrier member comprising:

an elongated barrier body providing a barrier surface that when the member is mounted on the pylons extends vertically for presentation to an observer as a visible barrier; and a pylon-engaging member at each end of the barrier body;

each pylon-engaging member having an aperture therein of diameter equal to an external diameter of the respective pylon adjacent to the upper end thereof, whereby with the pylon-engaging member mounted on the pylon upper end with the pylon uppermost end portion protruding through the aperture the pylon-engaging member and the barrier member are thereby retained against transverse movement relative to the pylon, and the pylon-engaging member is also retained against downward movement on the pylon so that the barrier surface is maintained at a corresponding predetermined distance above the road surface.

The pylon-engaging member may comprise a hook-like member extending from the respective end of the barrier body. Preferably the pylon-engaging member is made from metal rod material of circular cross section to provide wedging tangential retaining engagement between the member and the sloping outer wall of the pylon with which it is in contact. Alternatively, the pylon-engaging member may comprise a flat plate-like member extending from the respective end of the barrier body.

The elongated barrier member may be of thin sheet material and the member may have a major portion of greater width which, when the member is mounted on its pylon, extends vertically and constitutes the said barrier surface, the member having another minor portion of narrower width extending at an angle to the major portion to increase the transverse rigidity of the member. The minor portion may extend from the upper edge of the major portion and the pylon-engaging members may be attached to the barrier member at the junction of the major and minor portions. The angle between the major and minor portions may be 135 degrees. The barrier surface may be provided with a central recess comprising a central part of the member displaced backward out of the plane of the member and surrounded by a border part, the central recess receiving legends and printing so that they are protected against scraping contact. The barrier member may be provided at its upper edge with means facilitating the attachment thereto of a barrier signal light, and it may be provided at its lower edge with means facilitating the attachment thereto of a barrier message sign.

DESCRIPTION OF THE DRAWINGS

Barrier members which are particular preferred embodiments of the invention will now be described, by way of example, with reference to the accompanying diagrammatic drawings, wherein:

FIG. 1 is a perspective view from above showing a typical application of the barrier members of the invention in connecting together a plurality of roadway pylons to form a continuous barrier protecting a work area including an open manhole;

FIGS. 2 and 3 are front elevations of two different lengths of barrier member;

FIG. 4 is a plane cross section of the barrier member of FIG. 2, taken on the 4—4 therein;

FIG. 5 is a top elevation of the pylon-engaging member employed in the barrier members of FIGS. 1–4;

FIG. 6 is a vertical longitudinal cross section through a pylon and an attachment member of FIGS. 1–5 to illustrate their wedging cooperation: and FIG. 7 is a top elevation of an additional different pylon-engaging member structure.

DESCRIPTION OF THE PREFERRED EMBODIMENTS

FIG. 1 shows a road surface 10 comprising a work area in which is located a manhole 12 normally closed by a manhole cover 14. The open manhole is protected by a barrier comprising a plurality of transversely spaced conical pylons 16, each immediately adjacent pair of pylons being connected together by a respective barrier member 18. Each pylon comprises a flat road surface engaging base portion 20, square in plan, from which extends vertically upwards an open ended upward inward tapered conical body portion 22 having an uppermost end portion 24. The body portion is hollow so that a number of the pylons can be stacked vertically one upon the other for compact storage. As described above, such pylons are usually moulded from a suitable coloured plastics material of one of the two colours normally employed for highway safety markers, usually generically identified as safety yellow and safety orange. The invention is not however limited to use with moulded plastic pylons, and could also be used for example with conical pylons made from thin metal sheet.

Each barrier member 18 is made from thin sheet metal (e.g. 16 gauge steel) and comprises a lower major wider portion 26 and an upper minor narrower portion 28 at the upper edge of the major portion, the two portions being inclined at an angle of 135 degrees to one another so that the member is convex on its front side and concave on its rear side, thus increasing considerably its transverse rigidity. A pylon-engaging member 30 extends from each end and is engaged on the upper end of its respective pylon, so as to connect the two pylons securely together. In this embodiment each pylon-engaging member 30 comprises a hook-like member formed from a length of round cross section metal rod, the stem 32 (FIG. 5) of which is fastened, as for example by welding, to the concave face of the barrier member at the junction between the portions 26 and 28. The member provides a circular aperture 34 of a diameter equal to an exterior diameter of the pylon close to its uppermost end, so that it can be engaged thereon with sufficient of the pylon end portion 24 protruding through the aperture for it to be retained securely against transverse movement, and also so that it cannot easily lift or be lifted off the pylon end. The diameters are also such that the pylon-engaging member, and therefore the barrier member, are mounted a predetermined minimum height above the road surface.

Although the pylon-engaging member could be a closed ring of suitable internal diameter, it is found that a hook-like member with a small gap 36, as specifically illustrated by FIG. 5, is preferred so that the entire surface of the member can be provided with a protective coating. The desired secure retention of the pylon-engaging member is facilitated, despite the relatively wide manufacturing tolerances encountered in the manufacture of both the pylons and the pylon engaging hook members, by the cooperative wedging action that is always obtained between the downwardly tapered pylon outer wall and the semicircular inner face of the aperture 34. Thus, with these cooperating shapes there is always adequate tangential surface wedging engagement between the inclined pylon surface and the rod semicircular surface. The retention is also facilitated by the "give" in the plastics material that is contacted by the member, so that the member can bite firmly into it, as illustrated by FIG. 6. The barrier is therefore easily installed by placing the pylons approximately in position and pushing barrier members of appropriate lengths down onto them; the barrier is as easily disassembled by pulling upwards on the barrier members until they separate from the pylons.

Each member 30 is fastened to the barrier body so that the axis of the aperture 34 and the surfaces of the major portions 26 are vertical, those surfaces therefore constituting vertical barrier surfaces that are viewed by an observer approaching the barrier. The entire barrier member body will usually be coated to be of the same distinctive safety colour used for the pylons. Each major barrier portion 26 is provided in its front face with a shallow recess 42 formed by pressing a central part of the portion backwards out of the plane of that portion into a parallel plane, the recess thus being surrounded by a border part provided by the remainder of the member. A smaller recess is provided in the embodiments of FIG. 1, while those provided in the embodiments of FIGS. 2 and 3 are larger and occupy much more of the area of the surface. Such a recess provides inexpensively a substantial increase in the rigidity of the barrier member, and has a particular very substantial advantage that a reflective coating, which is desirable on the front face of the barrier, is protected against damage by scraping contact to which the member inevitably is subjected in use, such scraping contact impacting the boarder instead of the reflective surface. The barrier surfaces, particularly the recessed portion may in addition bear a suitable legend in a contrasting colour, such as "caution", "danger", "welcome", and/or the name of the business or authority.

FIGS. 2 and 3 illustrate barrier members of two different lengths, the lengths being related in modular manner to facilitate calculation of the inventory needed for a particular barrier installation. Each body major portion is provided along its upper edge with a bolt- receiving aperture 38 comprising attachment means by which, for example, a bracket carrying a flashing barrier signal or and additional directional sign can be attached to the barrier member. The bracket height is selected to raise the signal or sign well up into the cone of vision of the operator of any vehicle approaching the barrier. Each portion 26 is also provided adjacent its lower edge with a pair of transversely spaced apertures 40 which can comprise attachment means for the attachment of a supplementary barrier sign, such as a diversion indication, to the member.

Specific types of plastic pylons currently available are of height between 45 cm and 70 cm (18 in and 28 in). The longer pylons are used predominantly in situations where the barrier members of the invention are to be employed and these taper from a base of about 27 cm (10.75 in) to an uppermost diameter of about 5.0 cm (2 in). The pylon-engaging members for use with such pylons are made of 9.4 cm (0.375 in) diameter steel rod with an aperture 34 of 6.875 cm (2.75 in) diameter, the gap 36 being of dimension between 3.125 mm and 6.25 mm (0.125 in and 0.25 in). Such an aperture allows the uppermost ends of the pylons to protrude about 6.25 cm–7.5 cm (2.5 in–3 in) above the members 30. Typically the barrier members are of length 120 cm (48 in), 180 cm (72 in) an 240 cm (96 in), only the two shorter members being illustrated. Preferably the major portion 26 is 10 cm (4 in) in height while the minor portion 28 is 2.5 cm (1 in) in height to give an overall height of 12.5 cm (5 in).

FIG. 7 is a plan view of another embodiment in which the major and minor barrier portions 26 and 28 are disposed at a right angle to one another so that the major portion remains in its desired vertical attitude, and in which the pylon-engaging members 30 are made from flat sheet material of a suitable heavy gauge, the members 30 being attached to the minor portion 28, as by welding, to extend therefrom. The inner surface of the aperture where it engages the outer surface of the pylon can be made to taper at an angle which matches the taper of the pylon wall, or it can be made semi-circular as with the members made from round cross section rod to provide tangential wedging contact.

I claim:

1. A barrier member adapted for mounting on a pair of spaced road mounted vertically extending conical pylon members each having an upper and a lower end;

the barrier member comprising an elongated barrier body providing a barrier surface that when the member is mounted on the pylons extends vertically for presentation to an observer as a visible barrier;

wherein the barrier body is of thin sheet material, has a major portion of greater with which, when the member is mounted on its pylons, extends vertically and constitutes the said barrier surface, and has another minor portion of narrower width extending at an angle to the major portion to increase the transverse rigidity of the member;

wherein the angle between the major and minor portions is 135 degrees; and the barrier member also comprising a pylon-engaging member at each end of the barrier body;

each pylon-engaging member having an aperture therein of diameter equal to an external diameter of the respective pylon adjacent to the upper end thereof, whereby with the pylon-engaging member mounted on the pylon upper end with the pylon uppermost end portion protruding through the aperture the pylon-engaging member and the barrier member are thereby retained against transverse movement relative to the pylon, and the pylon-engaging member is also retained against downward movement on the pylon so that the barrier surface is maintained at a corresponding predetermined distance above the road surface.

2. A barrier member as claimed in claim 1, wherein the pylon-engaging member comprises a hook-like member extending from the respective end of the barrier body.

3. A barrier member as claimed in claim 1, wherein each pylon-engaging member is made from metal rod material of circular cross section to provide wedging tangential retaining contact between the member and the sloping outer wall of the pylon with which it is in contact.

4. A barrier member as claimed in claim 1, wherein the minor portion extends from the upper edge of the major portion and the pylon-engaging members are attached to the barrier member at the junction of the major and minor portions.

5. A barrier member as claimed in claim 1, wherein the barrier member is provided at its upper edge with means facilitating the attachment thereto of a barrier signal light.

6. A barrier member as claimed in claim 1, wherein the barrier member is provided at its lower edge with means facilitating the attachment thereto of a barrier message sign.

7. A barrier member as claimed in claim 1, wherein the barrier surface is provided with a central recess comprising a central part of the barrier body displaced backward out of the plane of the body and surrounded by a border part, the central recess receiving legends and printing so that they are protected against scraping contact.

8. A barrier member as claimed in claim 1, wherein the pylon-engaging member comprises a flat plate-like member extending from the respective end of the barrier body.

9. A barrier member adapted for mounting on a pair of spaced road mounted vertically extending conical pylon members each having an upper and a lower end;

the barrier member comprising an elongated barrier body providing a barrier surface that when the member is mounted on the pylons extends vertically for presentation to an observer as a visible barrier;

wherein the barrier body is of thin sheet material, has a major portion of greater width which, when the member is mounted on its pylon, extends vertically and constitutes the said barrier surface, and has another minor portion of narrower width extending from the upper edge of the major portion at an angle thereto to increase the transverse rigidity of the member; and the barrier member also comprising a pylon-engaging member at each end of the barrier body attached to the barrier member at the junction of the major and minor portions;

each pylon-engaging member having an aperture therein of diameter equal to an external diameter of the respective pylon adjacent to the upper end thereof, whereby with the pylon-engaging member mounted on the pylon upper end with the pylon uppermost end portion protruding through the aperture the pylon-engaging member and the barrier member are thereby retained against transverse movement relative to the pylon, and the pylon-engaging member is also retained against downward movement on the pylon so that the barrier surface is maintained at a corresponding predetermined distance above the road surface.

10. A barrier member as claimed in claim 9 wherein the pylon-engaging member comprises a hook-like member extending from the respective end of the barrier body.

11. A barrier member as claimed in claim 9, wherein each pylon-engaging member is made from metal rod material of circular cross section to provide wedging tangential retaining contact between the member and the sloping outer wall of the pylon with which it is in contact.

12. A barrier member as claimed in claim 9, wherein the barrier surface is provided with a central recess comprising a central part of the barrier body displaced backward out of the plane of the body and surrounded by a border part, the central recess receiving legends and printing so that they are protected against scraping contact.

13. A barrier member as claimed in claim 9, wherein the pylon-engaging member comprises a flat plate-like member extending from the respective end of the barrier body.

14. A barrier member adapted for mounting on a pair of spaced road mounted vertically extending conical pylon members each having an upper and a lower end;

the barrier member comprising an elongated barrier body providing a barrier surface such that when the member is mounted on the pylon members said barrier surface extends vertically for presentation to an observer as a visible barrier;

wherein the barrier surface is provided with a central recess completely surrounded by a planar border part, said central recess comprising a central part of the barrier body displaced backward from said planar border part, the central recess receiving legends and printing so that they are protected against scraping contact by said border part; and a pylon-engaging member at each end of the barrier body; each pylon-engaging member having an aperture therein of diameter equal to an external diameter of the respective pylon adjacent to the upper end thereof, whereby with the pylon-engaging member mounted on the pylon upper end with the pylon uppermost end portion protruding through the aperture the pylon-engaging member and the barrier member are thereby retained against transverse movement relative to the pylon, and the pylon-engaging member is also retained against downward movement on the pylon so that the barrier surface is maintained at a corresponding predetermined distance above the road surface.

15. A barrier member as claimed in claim 14, wherein the pylon-engaging member comprises a hook-like member extending from the respective end of the barrier body.

16. A barrier member as claimed in claim 14, wherein each pylon-engaging member is made from metal rod material of circular cross section to provide wedging tangential retaining contact between the member and the sloping outer wall of the pylon with which it is in contact.

17. A barrier member as claimed in claim 14, wherein the pylon-engaging member comprises a flat plate-like member extending from the respective end of the barrier body.

* * * * *